US005269038A

United States Patent [19]

Bradley

[11] Patent Number: 5,269,038

[45] Date of Patent: Dec. 14, 1993

[54] ROCKER TOOTHBRUSH

[76] Inventor: Terry G. Bradley, Box 1749, Howell, Utah 84316

[21] Appl. No.: 745,892

[22] Filed: Aug. 16, 1991

Related U.S. Application Data

[63] Continuation-in-part of Ser. No. 677,656, Mar. 29, 1991.

[51] Int. Cl.[5] ..... A46B 9/04

[52] U.S. Cl. ..... 15/167.1; 15/201; 403/291; D4/105

[58] Field of Search ..... D4/104–113, D4/119, 130, 132, 134, 137; 15/106, 110, 159 R, 160, 167.1, 194, 201, 202, 176.1–176.6, 172; 433/141, 142; 16/223–225, 227, 260, DIG. 13; 128/62 A; 132/308; 403/331, 381, 291

[56] References Cited

U.S. PATENT DOCUMENTS

| | | | |
|---|---|---|---|
| 1,212,001 | 1/1917 | Baxter . | |
| 1,225,955 | 5/1917 | Hickman . | |
| 1,270,233 | 6/1918 | Stoorman . | |
| 1,620,330 | 3/1927 | Douglass . | |
| 1,968,303 | 7/1934 | McMath . | |
| 2,122,619 | 7/1938 | McMath . | |
| 2,172,624 | 9/1939 | Robert | 15/167.1 |
| 2,220,053 | 10/1940 | Pruner . | |
| 2,246,867 | 6/1941 | Thomas et al. . | |
| 2,263,802 | 11/1941 | Grusin | 15/110 |
| 2,582,552 | 1/1952 | Marco | 15/167.1 |
| 2,583,886 | 1/1952 | Schlegel . | |
| 2,655,674 | 10/1953 | Grover . | |
| 2,691,187 | 10/1954 | Lorenz . | |
| 2,882,544 | 4/1959 | Hadidian | 15/201 X |
| 2,935,755 | 5/1960 | Leira et al. | 15/167.1 |
| 3,082,457 | 3/1963 | Lucibello et al. | 15/201 X |
| 3,129,449 | 4/1964 | Cyzer | 15/201 X |
| 3,152,349 | 10/1964 | Brennesholtz . | |
| 3,290,949 | 12/1966 | Samet | 403/291 X |
| 3,879,791 | 4/1975 | Isler . | |
| 3,978,852 | 9/1976 | Annoni . | |
| 4,317,463 | 3/1982 | Massetti . | |
| 4,333,199 | 6/1982 | Del Rosario | 15/172 X |
| 4,488,328 | 12/1984 | Hyman . | |
| 4,575,894 | 3/1986 | Stevens et al. | 15/172 |
| 4,633,542 | 1/1987 | Taravel | 15/201 X |
| 4,691,718 | 9/1987 | Sakuma et al. . | |
| 4,694,844 | 9/1987 | Berl et al. | 15/201 X |
| 4,712,267 | 12/1987 | Cheng . | |
| 5,121,520 | 6/1992 | Brice | 15/167.1 |

FOREIGN PATENT DOCUMENTS

| | | | |
|---|---|---|---|
| 1210409 | 2/1966 | Fed. Rep. of Germany | 15/201 |
| 141640 | 4/1920 | United Kingdom | 15/167.1 |

*Primary Examiner*—Harvey C. Hornsby
*Assistant Examiner*—Charles Cooley
*Attorney, Agent, or Firm*—Workman, Nydegger & Jensen

[57] ABSTRACT

A toothbrush which automatically provides an up-down stroking action in concert with a side-to-side stroking action as the brush is stroked side-to-side along the teeth of a user. The brush incorporates two pairs of elongate bristle-carrying pads with the pads of each pair positioned side-by-side and the pairs end-to-end. Each pad is hinged to the pad-holding end of the brush with the hinge axis being angularly related to the elongate axis of the pad. The hinge comprises a relatively thin elongate web having a substantially hour-glass cross-sectional shape.

24 Claims, 6 Drawing Sheets

ROCKER TOOTHBRUSH

Related Applications

This application is a continuation-in-part of my copending application, titled "Rocker Toothbrush," filed Mar. 29, 1991, Ser. No. 07/677,656.

BACKGROUND

Field of the Invention

The present invention is in the field of toothbrushes, particularly toothbrushes devised to impart an up-down motion as the brush is stroked side-to-side along a user's teeth.

Technology Review

Throughout the years a large variety of toothbrushes have been devised with the objective in mind of providing a brush that does a better job of cleaning teeth. In general, all brushes have in common an elongate member with a handle to be grasped by the user and bristles positioned at one end for brushing against the teeth. Some have employed elongate members with straight handles and some have employed members with angled handles.

Most dentists have usually advised their patients to brush with up-and-down strokes across the sides of their teeth perpendicular to the gum line rather than side-to-side strokes across the sides of the teeth parallel to the gum line. However, this practice is awkward and consequently not faithfully followed. At least one important reason for such up-and-down stroking is to cause the bristles to penetrate slightly between the teeth and the gum. Most periodontal disease originates as a result of bacteria residing in this region. Brushing in this manner minimizes the start and growth of such disease. Such brushing has been deemed so advisable that some brushes have been devised with electric means, such as vibrators, to effect such a motion. However, these are expensive and have not generally found favor with the public. Consequently it seemed desirable to have a toothbrush which did not incorporate a vibrator but which would permit a user to brush in a convenient side-to-side fashion while at the same time effecting an up-and-down motion of the bristles so as to penetrate slightly the space between the teeth and the gum. However, such a brush has not heretofore been available.

BRIEF SUMMARY AND OBJECTS OF THE INVENTION

The present invention seeks to resolve the problem as noted above and to provide other improvements. Specifically:

It is an object of the present invention to provide a brush which effects an up-and-down motion of the bristles while the brush is stroking the teeth in a side-to-side fashion.

It is a further object of the present invention to provide a brush that effects a slight penetration of the bristles between the teeth and the gums as the brush is stroking the teeth in a side-to-side fashion.

It is a further object of the present invention to provide a brush that effects a brushing of each tooth at all angles as the brush is stroking the teeth in a side-to-side fashion.

It is a further object of the invention to provide a brush that brushes a region wider than the bristles of the brush, thus providing more effective coverage.

It is a further object of the invention to provide a brush that effects a swirling action of the bristles across the teeth as the brush is stroking the teeth in a side-to-side fashion.

It is a further object of the invention to provide a brush that accomplishes the above objectives without the incorporation of an electric device such as a vibrator.

It is a further object of the invention to provide a brush having means for water lubrication and cleaning.

Briefly summarized, the foregoing objects and advantages are realized by the toothbrush of the present invention. The invention comprises a brush having an elongate handle with means at the distal end devised to hold the bristles. The bristles are affixed in bristle-holding elongate pads which are integral with and configured so as to be hingedly attached to the pad-holding distal end of the toothbrush. Preferably there will be four such bristle-holding pads although there could be more or less. Each pad is of elongate configuration devised so as to secure, preferably, two elongate rows of bristles. The bristles are of conventional design as are found in other toothbrushes.

The pads are so sized and configured as to permit a pair of pads to be preferably positioned in a side-by-side relationship with a relatively small space between, for reasons explained below. A second similar pair of pads is preferably positioned in an end-to-end relationship to the first pair with a relatively small space between. The entire assembly of four pads is so sized and configured as to occupy approximately the same area at the distal end of the toothbrush as do the bristles in conventional toothbrushes.

As noted above, each pad is hingedly attached to the pad-holding distal end of the toothbrush. The hinged attachment comprises, preferably, an elongate web, interconnecting the pad to the distal end of the toothbrush, and positioned so as to have the hinge axis form an acute angle with respect to the elongate axis of the pad. The hinge axes of a pair of pads are preferably so arranged as to form a substantially "V" configuration. However, as noted above, adjacent pads have a space between them, and therefore the apex at the "V" is open, i.e., the legs of the "V" do not come completely together.

Additionally, each pair of pads is, preferably, so arranged that the corresponding open apexes of the "V"s are adjacent to each other although there is a space between, as noted above. Alternatively, the pairs could be so arranged that the mouths of the "V"s were adjacent each other.

The hinge comprises, preferably, a relatively thin elongate web which is an integral part of the distal end of the toothbrush and is positioned so as to interconnect the bottom of the pad to the pad-holding distal end of the brush.

The web comprises a substantially hour-glass shaped cross-section which, as indicated, serves to connect the bottom of the pad to the distal end of the brush. The web is configured with a relatively short, but preferred, connecting dimension, as to be described in more detail below.

As the hinge pivots back and forth, the bristle-holding pad rocks back and forth. The importance of the connecting dimension of the web now becomes apparent. This dimension must be such as to permit the base of the pad to be spaced above the pad-holding end of the brush so as to allow the pad to rock a preferred amount before it strikes the pad-holding end. At the same time this dimension must not be too great or the pad would rock too far. Preferably the configuration will be such that the pad can rock back and forth through an angle of approximately 45°.

The reason for the spacing between adjacent pads also now becomes apparent. The spacing is preferably such that as adjacent pads rock oppositely so as to bring the bristles towards each other the bristles impact each other but do not significantly intermesh. Furthermore, the pads rock without mutual interference.

The use of the toothbrush will now be explained. As noted before, each pad has its hinge axis arranged to be at an acute angle with respect to the elongate longitudinal axis of the pad. As the brush is stroked side-to-side along the teeth of a user the pads move back and forth in a longitudinal direction. At the same time, as can be shown by a kinematic analysis, the pair of pads which has the apex of its "V" shape facing the direction of motion will rock transverse to the direction of motion, outwardly and oppositely to each other, thus spacing their bristles farther apart. Conversely, the pair of pads which has the mouth of its "V" shape facing the direction of motion will rock transverse to the direction of motion, inwardly and oppositely to each other, thus bringing their bristles closer together. Thus as the brush is stroked side-to-side along the sides of a user's teeth each pair of bristles rocks first one way and then the other, providing an up-and-down motion. A kinematic analysis shows that the tip of any given bristle follows an elliptical trajectory as the brush is stroked side-to-side, thus resulting in a swirling motion. Thus an enlarged area is brushed by the bristles over that provided by an ordinary brush. Furthermore this effects an action whereby the bristles penetrate slightly into the space between the teeth and gum of a user. This has been found to be very beneficial in mitigating against periodontal disease.

The pads, webs, and body of the toothbrush are preferably molded from a plastic which is sufficiently strong, but yet somewhat elastic, such that the web hinges preferably assume a neutral position when not being activated.

As a further refinement, drain holes are preferably provided through the body of the brush which communicate at one end with the web hinges and at the other end with open space. Thus the brush can be washed and kept free of debris.

It should be noted that for purposes of this specification the hinge axis is alternatively termed the transverse motion or tilting axis, being the axis along which, or about which, a transverse motion of a pad takes place as the brush is stroked along the elongate axis of the pad.

BRIEF DESCRIPTION OF THE DRAWINGS

In order to more fully understand the manner in which the above-recited advantages and objects of the invention are obtained, a more particular description of the invention will be rendered by reference to a specific embodiment thereof which is illustrated in the appended drawings. Understanding that these drawings depict only one typical embodiment of the invention and are therefore not to be considered limiting of its scope, the presently preferred embodiment and the presently understood best mode of the invention will be described with additional detail through use of the accompanying drawings in which.

DETAILED DESCRIPTION OF THE PREFERRED EMBODIMENTS

Reference is now made to the drawings wherein like parts are designated with like numerals throughout.

Figure 1:
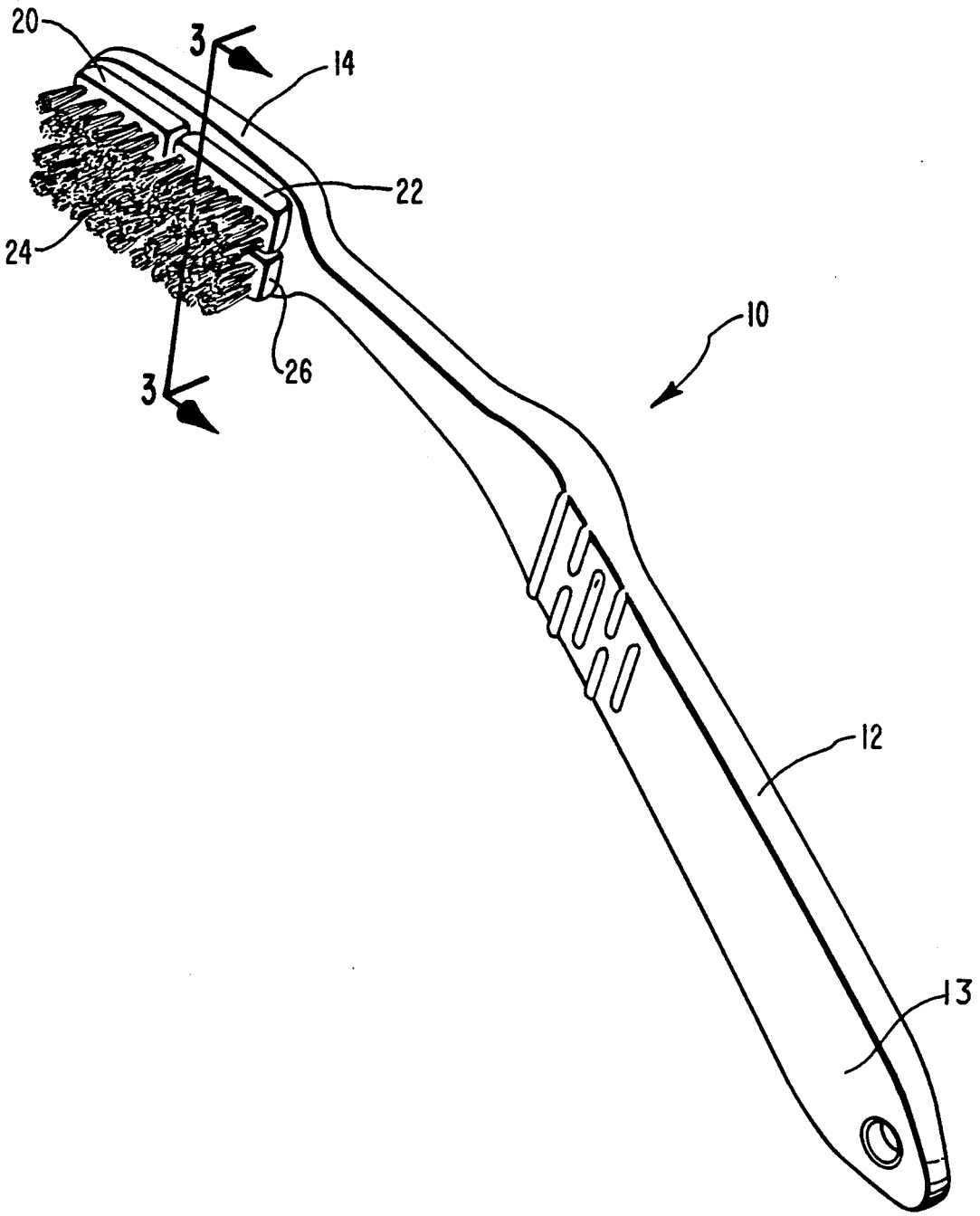
FIG. 1 is a perspective view of the toothbrush having two pairs of bristle-carrying pads with two rows of bristles on each pad.

Referring first to FIG. 1, the toothbrush 10 is shown having a conventional elongate handle 12 having a proximal end 13 and opposite there to a bristle pad-holding distal end 14 configured in conformity with the present invention. As shown, there are preferably four distinct bristle supports taking the form of pads, 20, 22, 24, and 26, which engage the pad-holding end 14. Likewise, as shown, there are preferably two rows of bristles per pad although there may be more or less.

Figure 2:
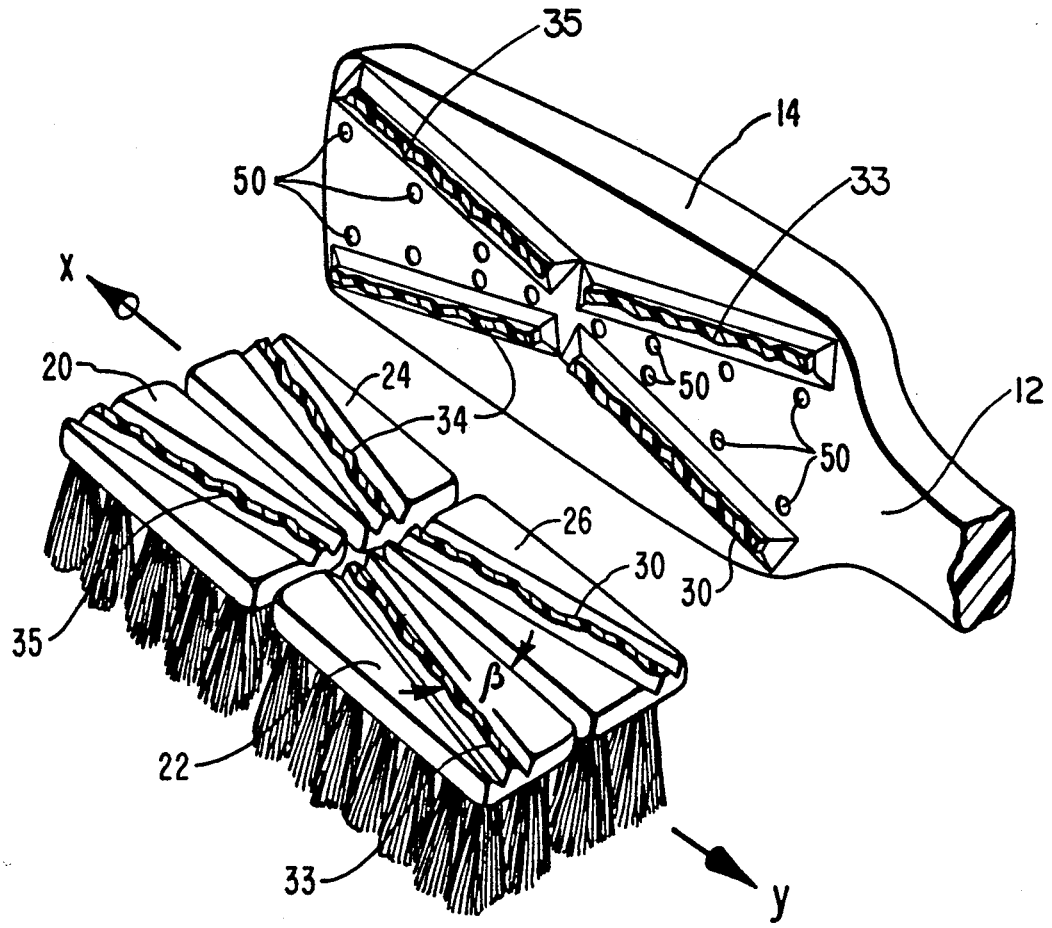
FIG. 2 is an exploded perspective view showing the pad-holding end of the toothbrush with the hinges artificially severed, for clarity.

As shown best in FIG. 2, each pad is devised so as to be hingedly attached to the pad-holding end 14. The attachment for each pad comprises a web hinge, such as hinge 30, which is affixed to pad 26. Similarly, for pads 20, 22 and 24 there are hinges 35, 33 and 34.

Figure 3:
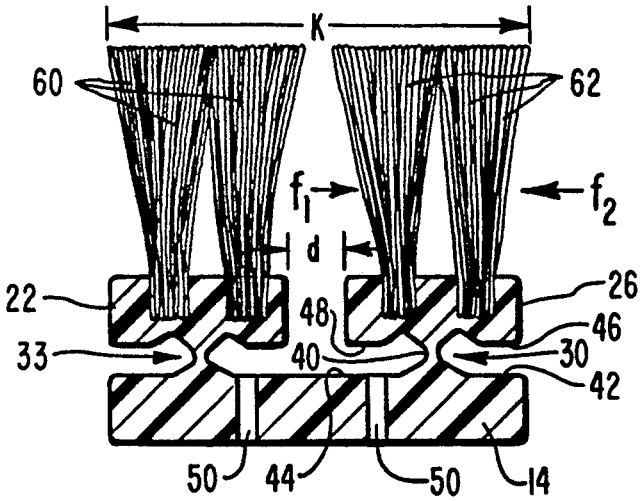
FIG. 3 is a cross sectional view taken along line 3—3 of FIG. 1, to an enlarged scale.

Preferably, hinge 30 is fashioned as an integral part of pad 26 and pad-holding end 14, as shown best in FIG. 3. Likewise, hinges 35, 33 and 34 are fashioned as integral parts of pad-holding end 14 and the corresponding pads.

Hinge 30 is configured so as to be substantially hourglass shaped in cross section having an elongate web 40 extending from pad-holding end 14 to pad 26.

Thus pad 26 can pivot freely in either of two opposite directions about the axis of web 40 when a pivotal force is applied to pad 26, normally by way of the free end of the bristles projecting from the top surface thereof, when the bristles bear against a surface, such as a tooth, and a force is applied to handle 14. However, the web is stiff enough that member 26 does not pivot by itself merely due to gravitational forces.

Figure 4:
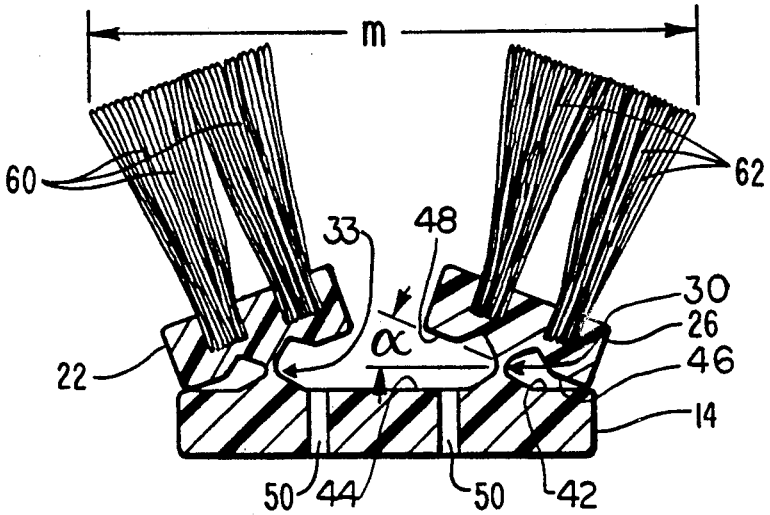
FIG. 4 is a cross sectional view corresponding to FIG. 3 except with the pads shown rocked away from each other.

With this assembly, then, as pivotal forces, depicted schematically as f, and $f_2$ in FIG. 3, are alternately applied to the bristles 60 on pad 22 and bristle 62 on pad 26, as explained in more detail below, pad 26 rocks back-and-forth. The angle $\alpha$ (see FIG. 4) through which the pad can rock is determined by the dimensions of web 40 and the contour of pad-holding end 14. As shown, pad-holding end 14 has surfaces 42 and 44 against which surfaces 46 and 48 of pad 26 abut when pad 26 is rocked to its limits. This is shown best in FIGS. 4 and 5. Preferably, the configuration is such that pad 26 can rock through an angle of approximately 45°, i.e., 22.5° ($\alpha$) in each direction, although this angle is not critical. However, it should preferably be within the range of 10° to 90°.

Figure 5:
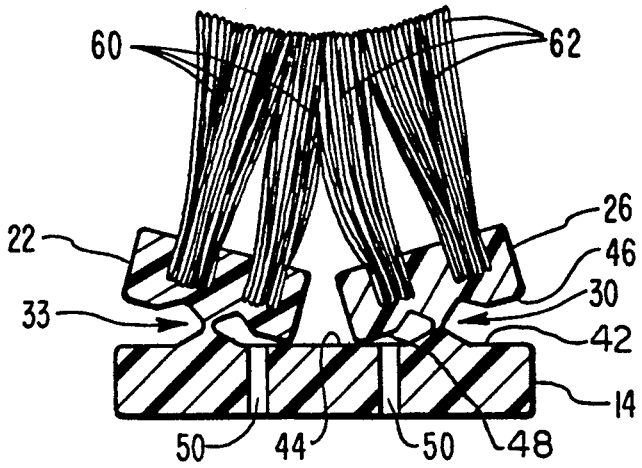
FIG. 5 is a cross sectional view corresponding to FIG. 3 except with the pads shown rocked towards each other.

The spacing "d," see FIG. 3, between adjacent pads 26 and 22 is such that when, the pads are rocked towards each other the tips of the bristles 60 and 62 impact each other but do not substantially intermesh, as shown in FIG. 5. The spacing is also such that pads 26 and 22 do not interfere with each other when rocked away from each other through their respective maximum angles, as depicted in FIG. 5.

A significant advantage of the toothbrush of this invention is the greater area of a tooth that is covered by bristle 60 as the brush is stroked from side-to-side by a user across the sides of each tooth. As depicted in FIG. 3 the up-down dimension that is covered by bristle 60 of a brush that did not rock is depicted as "k." In FIG. 4 this dimension for a brush that does rock is depicted as "m." As can be seen, "m" is significantly greater "k."

Figure 8:
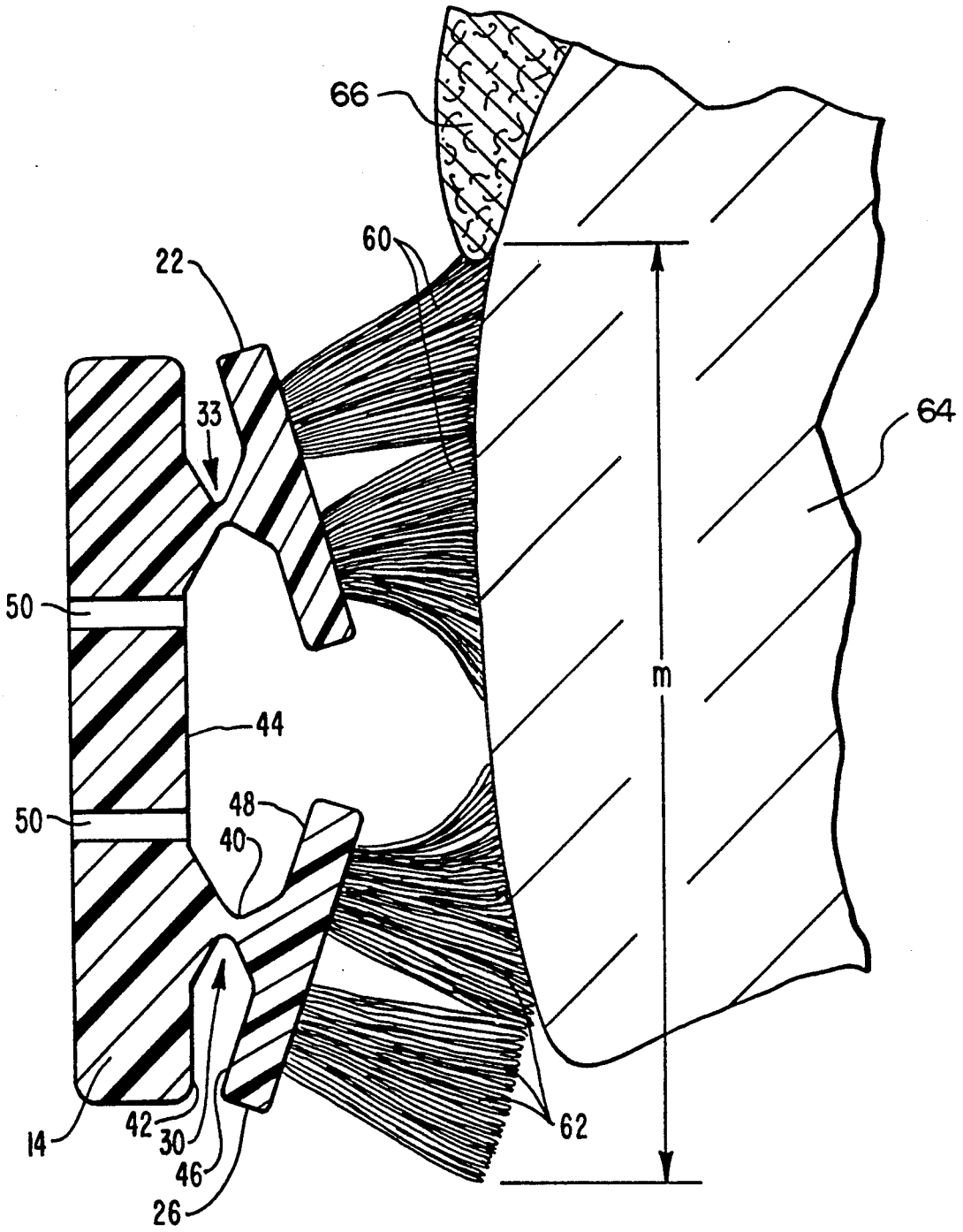
FIG. 8 is a cross-sectional view corresponding to FIG. 4 showing the bristles rocked away from each other and penetrating the gum line.
Figure 9:
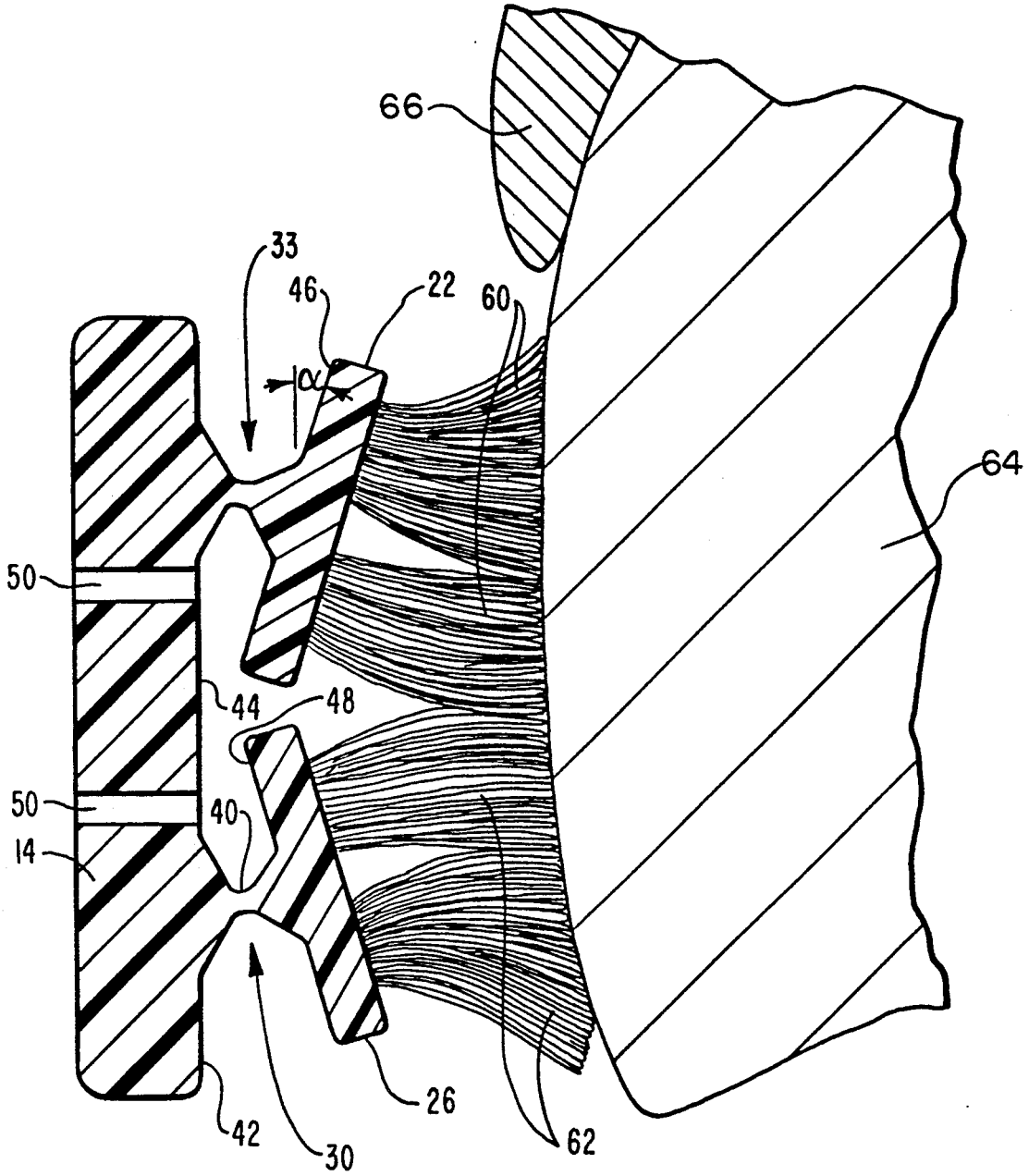
FIG. 9 is a view corresponding to FIG. 8 except with the brushes rocked towards each other.

Another significant advantage accruing from the use of the invention is the cleaning that occurs between the tooth and the gum line, as depicted in FIG. 8. As pad 22 rocks outwardly, some of the bristles 60 protrude slightly into the space between the tooth 64 and the gum 66, as shown. This cleaning action significantly reduces the onslaught of periodontal disease.

Another feature of the invention is the incorporation of drain holes, such as 50 shown in FIGS. 2, 3, 4 and 5. A plurality of drain holes communicate at one end with the space near the hinges and at the other end with open space, all as shown. These facilitate the cleaning of the brush, especially the hinge, by allowing water to circulate therethrough.

The rocking action of the pads and bristles in the present invention is now explained in more detail. As shown in FIG. 2 the hinge 30 of pad 26 is so positioned that it forms an acute angle "$\beta$" with respect to the elongate axis of the pad, or the longitudinal axis defined by handle 13. Adjacent pads 22 and 26 are positioned such that hinges 30 and 33 are at an angle, forming substantially a "V" shape with the apex of the "V" in the center of the brush and the mouth of the "V" at the end. Likewise, pads 20 and 24 are similarly positioned at an angle, with the apex of the "V" formed by hinges 34 and 35 adjacent to the apex of the "V" formed by hinges 30 and 33. Although this is a preferred configuration the pads can be so positioned that the mouths of the "V"s are adjacent rather than the apexes of the "V"s.

Now, as the brush is stroked along the sides of a user's teeth parallel to the longitudinal axis of handle 12 in a direction as indicated by "x" in FIG. 2, pads 20 and 24 will rock outwardly about the respective hinge of each, oppositely from each other, so as to spread their corresponding bristles further apart. At the same time pads 22 and 26 will rock inwardly about the respective hinge of each so as to cause their corresponding bristles to come together. When the brush is stroked in the opposite other direction parallel to handle 12, as indicated by "y," the pads will rock in a reverse manner: pads 20 and 24 will rock inwardly, and pads 22 and 26 will rock outwardly. Thus, back-and-forth stroking of the brush parallel to the longitudinal axis of handle 12 will effect repetitive rocking motions of the pads in opposite directions about the respective hinge of each. This produces a swirling motion of the bristles on the teeth wherein any given bristle follows an elliptical trajectory on the teeth. As a consequence, each tooth is brushed in all directions. Stated another way, an up-down brushing by bristles 60 is effected by the inwardly and outwardly motion of the bristles simultaneously with a side-to-side brushing motion parallel to the longitudinal axis of the handle.

Figure 6:
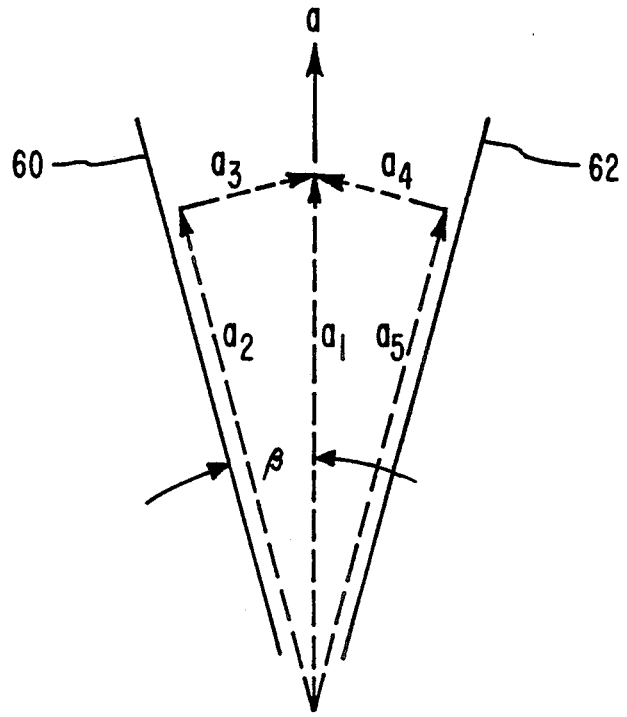
FIG. 6 is a schematic representation of the forces acting on the free ends of bristles attached to the pads so as to cause the pads to rock towards each other.
Figure 7:
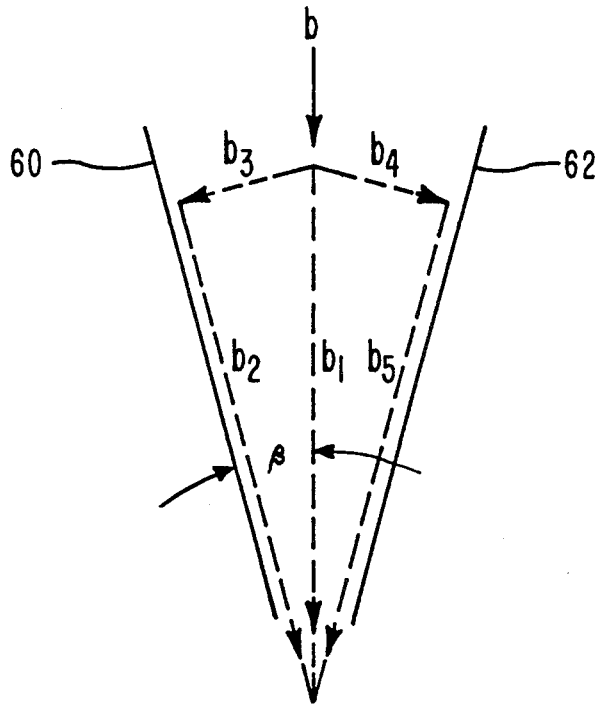
FIG. 7 is similar to FIG. 6 except that the forces acting on the free ends of the bristles cause the pads to rock away from each other.

The forces which create these rocking motions are evident from a simple kinematic analysis as shown in FIGS. 6 and 7. Referring to FIG. 6, 60 and 62 represent, in schematic form, a plan view of the tips of bristles in pads 22 and 26 above hinges 33 and 30, respectively. The arrow "a" represents the direction of a force of magnitude $a_1$ transmitted to these bristle tips when the bristle tips engage a surface and brush 10 is advanced in a direction indicating by arrow V in FIG. 2. For bristle tips 60, $a_1$ is composed of forces $a_2$, directed along the elongate axis of the bristles, and $a_3$, orthogonal thereto. The force $a_3$ acts at the end of a crank arm of the hinge 33, as shown in FIG. 5. The crank arm is comprised of a combination of the bristles and the pad 22. As can be seen, this force then rotates the tips of the bristles, and the thus the pad inwardly. Similarly, for bristle tips 62, $a_1$ is composed of forces $a_5$, directed along the elongate axis of the bristles, and $a_4$, orthogonal thereto. Thus, in a similar manner $a_4$ rotates the tips of the bristles, and thus the pad, inwardly.

The forces applicable when the bristle tips engage a surface and brush 10 is advanced in a direction indicated by arrow y in FIG. 2 of FIG. 7 can be analyzed in similar fashion in relation to FIG. 7. There force "b" is directed oppositely to force "a" of FIG. 6, and the bristles rotate oppositely, as suggested by force arrows $b_3$ and $b_4$, which rock the pads outwardly.

In summary, all of the stated objectives have been achieved by the instant invention. As illustrated by the kinematic analysis an up-down motion is provided as the brush strokes the teeth in a side-to-side fashion. Further this up-down motion permits the bristles of the brush to penetrate the gum line, and to cover a wider area than would otherwise be possible. Additionally, the combination of the up-down motion and the side-to-side motion effects a brushing of the teeth at all angles, and imparts a swirling motion to the bristles as they cross the teeth. And lastly, this up-down motion is provided without the use of electric vibrators or equivalents.

The present invention may be embodied in other specific forms without departing from its spirit or essential characteristics. The described embodiments are to be considered in all respects only as illustrative and not restrictive. The scope of the invention is, therefore, indicated by the appended claims rather than by the foregoing description. All changes which come within the meaning and range of equivalency of the claims are to be embraced within their scope.

What is claimed and desired to be secured by United States Letters Patent is:

1. A toothbrush comprising:

(a) an elongated handle having a proximal and a distal end and defining therebetween a longitudinal axis of said handle;

(b) a bristle support having opposed top and bottom surfaces and bristles projecting from said top surface thereof; and (c) bristle support attachment means for tiltably securing said bristle support to said distal end of said handle with said bristles projecting away from said handle for tilting movement only in either of two opposite directions about a tilting axis disposed at an acute angle to said longitudinal axis of said handle, said tilting axis being aligned with said bristle support attachment means.

2. A toothbrush as recited in claim 1, wherein said bristle support attachment means comprises a hinge interconnecting said bottom surface of said bristle support to said distal end of said handle, said hinge being aligned with said tilting axis.

3. A toothbrush as recited in claim 2, wherein said hinge, said bristle support, and said handle are of a one-piece construction.

4. A toothbrush as recited in claim 2, wherein said hinge comprises an elongated web upstanding along said tilting axis from said distal end of said handle, said web supporting said bristle support in a spaced-apart relationship to said distal end of said handle.

5. A toothbrush as recited in claim 4, wherein said web has a lateral cross-section substantially in the shape of an hourglass.

6. A toothbrush as recited in claim 5 wherein said web is so configured as to bias said bristle support into a predetermined position relative to said distal end of said handle, while permitting tilting movement of said bristle support out of said predetermined position thereof about said tilting axis when the ends of said bristles remote from said bristle support bear against a surface and a force is applied parallel to said longitudinal axis of said handle by a user.

7. A toothbrush as recited in claim 1, wherein said bristles are disposed in plural rows on said top surface of said bristle support.

8. A toothbrush as recited in claim 1, further comprising a drain hole formed through said distal end of said handle proximate to said bristle support attachment means.

9. A toothbrush, comprising:

(a) an elongated handle having a proximal and a distal end and defining therebetween a longitudinal axis of said handle;

(b) a first bristle support having opposed top and bottom surfaces and bristles projecting from said top surface thereof;

(c) a first bristle support attachment means for tiltingly securing said first bristle support to said distal end of said handle with said bristles of said first bristle support projecting away from said handle for tilting movement only in either of two opposed directions about a first axis disposed at an acute angle to said longitudinal axis of said handle, said first axis defining a first tilting axis being aligned with said first bristle support attachment means;

(d) a second bristle support having opposed top and bottom surfaces and bristles projecting from said top surface thereof; and (e) second bristle support attachment means for tiltingly securing said second bristle support to said distal end of said handle with said bristles of said second bristle support projecting away from said handle for tilting movement only in either of two opposite directions about a second axis disposed at an acute angle to said longitudinal axis of said handle, said second axis defining a second tilting axis being aligned with said second bristle support attachment means.

10. A toothbrush as recited in claim 9, wherein said second bristle support is positioned on said distal end of said handle laterally adjacent to said first bristle support.

11. A toothbrush as recited in claim 9, wherein said second bristle support is secured to said distal end of said handle in longitudinal alignment with said first bristle support.

12. A toothbrush as recited in claim 9, wherein:

(a) said first bristle support attachment means comprises a first hinge interconnecting said distal end of said handle and said bottom surface of said first bristle support, said first hinge being aligned with said first tilting axis; and (b) said second bristle support attachment means comprises a second hinge interconnecting said distal end of said handle and said bottom surface of said second bristle support, said second hinge being aligned with said second tilting axis.

13. A toothbrush as recited in claim 12, wherein said first hinge, said first bristle support, and said distal end of said handle are of a one-piece construction, and wherein said second hinge, said second bristle support, and said distal end of said handle are of a one-piece construction.

14. A toothbrush as recited in claim 9, wherein said first tilting axis is disposed at an oblique angle to said second tilting axis.

15. A toothbrush, comprising:

(a) an elongated handle having a proximal and a distal end and defining therebetween a longitudinal axis of said handle;

(b) a first bristle support having opposed top and bottom surfaces and bristles projecting from said top surface thereof;

(c) a first bristle support attachment means for tiltably securing said first bristle support to said distal end of said handle with said bristles of said first bristle support projecting away from said handle for tilting movement only in either of two opposed directions about a first axis disposed at an acute angle to said longitudinal axis of said handle, said first axis defining a first tilting axis being aligned with said first bristle support attachment means, said first bristle support attachment means comprising a first hinge interconnecting said distal end of said handle and said bottom surface of said first bristle support, said first hinge being aligned with said first tilting axis;

(d) a second bristle support having opposed top and bottom surfaces and bristles projecting from said top surface thereof; and (e) second bristle support attachment means for tiltably securing said second bristle support to said distal end of said handle with said bristles of said second bristle support projecting away from said handle for tilting movement only in either of two opposite directions about a second axis disposed at an acute angle to said longitudinal axis of said handle, said second axis defining a second tilting axis being aligned with said second bristle support attachment means, said second bristle support attachment means comprising a second hinge interconnecting said distal end of said handle and said bottom surface of said second bristle support, said second hinge being aligned with said second tilting axis.

16. A toothbrush as recited in claim 15, wherein said first hinge, said first bristle support, and said distal end of said handle are of a one-piece construction, and wherein said second hinge, said second bristle support, and said distal end of said handle are of a one-piece construction.

17. A toothbrush as recited in claim 15, wherein said first hinge comprises an elongated first web upstanding along said first tilting axis from said distal end of said handle, said first web supporting said first bristle support in a spaced-apart relationship to said distal end of said handle; and wherein said second hinge comprises a elongated second web upstanding along said second tilting axis from said distal end of said handle, said second web supporting said second bristle support in a spaced-apart relationship to said distal end of said handle.

18. A toothbrush as recited in claim 17, wherein said first web and said second web each have a lateral cross-section substantially in the shape of an hourglass.

19. A toothbrush as recited in claim 15, wherein said first hinge is so configured so as to bias said first bristle support into a first predetermined position relative to said distal end of said handle, while permitting tilting movement of said first bristle support out of said first predetermined position thereof about said tilting axis when the ends of said bristles remote from said first bristle support bear against a surface and a force is applied parallel to said longitudinal axis of said handle by a user; and wherein said second hinge is so configured as to bias said second bristle support into a second predetermined position relative to said distal end of said handle, while permitting tilting movement of said second bristle support out of said second predetermined position thereof about said tilting axis when the ends of said bristles remote from said second bristle support bear against a surface and a force is applied parallel to said longitudinal axis of said handle by a user.

20. A toothbrush comprising:

(a) an elongated handle having a proximal and a distal end and defining therebetween a longitudinal axis of said handle;

(b) a bristle support having opposed top and bottom surfaces and bristles projecting from said top surface thereof; and (c) an elongated hinge securing said bottom surface of said bristle support to said distal end of said handle, said hinge supporting said bristle support in spaced-apart relationship thereto for tilting movement only in either of two opposite directions about a tilting axis aligned with and defined by said hinge, said tilting axis being disposed at an acute angle to said longitudinal axis of said handle.

21. A toothbrush as recited in claim 20, wherein said hinge, said bristle support, and said distal end of said handle are of a one-piece construction.

22. A toothbrush as recited in claim 20, wherein said hinge comprises an elongated web upstanding along said tilting axis from said distal end of said handle, said web supporting said bristle support in a spaced-apart relationship to said distal end of said handle.

23. A toothbrush as recited in claim 22, wherein said web has a lateral cross-section substantially in the shape of an hourglass.

24. A toothbrush as recited in claim 20, wherein said hinge is so configured as to bias said bristle support into a predetermined position relative to said distal end of said handle, while permitting tilting movement of said bristle support out of said predetermined position thereof about said tilting axis when the ends of said bristles remote from said bristles support bear against a surface and a force is applied parallel to said longitudinal axis of said handle by a user.

* * * * *

UNITED STATES PATENT AND TRADEMARK OFFICE

CERTIFICATE OF CORRECTION

PATENT NO. : 5,269,038

DATED : December 14, 1993

INVENTOR(S) : Terry G. Bradley

It is certified that error appears in the above-indentified patent and that said Letters Patent is hereby corrected as shown below:

Column 4, line 35, "there to" should be --thereto--.
Column 5, line 9, "see FIG. 3," should be --as seen in FIG. 3,--.
Column 5, line 10, delete " , ".
Column 5, line 11, after "other" insert --,--.
Column 5, line 12, after "other" insert --,--.
Column 5, line 12, after "intermesh" delete the ",".
Column 5, line 21, after "FIG. 3" insert --,--.
Column 5, line 25, after "greater" insert --than--.
Column 5, line 52, after "configuration" insert --,--.
Column 5, line 54, after "adjacent" insert --,--.
Column 6, line 19, "indicating" should be --indicated--.

Column 9, line 14, "a" should be --an--.

Signed and Sealed this

Twenty-first Day of November, 1995

*Attest:*

Bruce Lehman

BRUCE LEHMAN

*Attesting Officer*

*Commissioner of Patents and Trademarks*